United States Patent [19]

Straitz, III

[11] 4,128,389

[45] Dec. 5, 1978

[54] FLARE STACK GAS BURNER

[75] Inventor: John F. Straitz, III, Meadowbrook, Pa.

[73] Assignee: Combustion Unlimited Incorporated, Elkins Park, Pa.

[21] Appl. No.: 826,932

[22] Filed: Aug. 22, 1977

[51] Int. Cl.[2] ..... F23D 13/20

[52] U.S. Cl. ..... 431/202; 431/114; 431/351

[58] Field of Search ..... 431/202, 114, 351

[56] References Cited

U.S. PATENT DOCUMENTS

| | | | |
|---|---|---|---|
| 3,547,567 | 12/1970 | Turpin | 431/202 |
| 3,730,673 | 5/1973 | Straitz | 431/202 |
| 3,822,985 | 7/1974 | Straitz | 431/202 |
| 3,824,073 | 7/1974 | Straitz | 431/202 |
| 4,038,024 | 7/1977 | Straitz | 431/202 |
| 4,039,276 | 8/1977 | Reed et al. | 431/202 |

*Primary Examiner*—Carroll B. Dority, Jr.
*Attorney, Agent, or Firm*—Zachary T. Wobensmith, 2nd; Zachary T. Wobensmith, III

[57] ABSTRACT

A flare stack gas burner for waste combustible gas from oil refineries, chemical plants, oil production rigs, LPG and other marketing terminals, pipe lines and the like is disclosed which includes a stack for waste gas delivery with an air delivery pipe therein with a plurality of outwardly extending hollow vanes at the top with fixed inclined nozzles along the tops of the vanes for discharge of air into the combustible gas advancing in the stack in a plurality of flat inclined streams at an inclination from the horizontal in a hollow frustoconical vortex combustion path, the inclined streams contacting combustible gas on each face and into the vortex path and around the exterior for completing combustion. The burner head has an enclosing shroud at the top to which steam is delivered at the bottom of the shroud for inducing combustion supporting air, the air being delivered in a hollow cylindrical stream surrounding the vortex path, with additional steam being introduced into and through the cylindrical stream, the air inlet path to the cylindrical stream being shielded to reduce noise emission.

11 Claims, 7 Drawing Figures

FLARE STACK GAS BURNER

BACKGROUND OF THE INVENTION

1. Field of the Invention

This invention relates to flare stack burners for waste combustible gas.

2. Description of the Prior Art

Various flare stack gas burners have heretofore been proposed for the combustion of waste gas but many of these had serious limitations, particularly because of inadequate turbulence and mixing of combustible and burning gases with air.

It has heretofore been proposed to use steam to induce air for contact with the burning gases and to direct steam into the burning gases.

The U.S. Pat. No. 2,761,496 to Verner; Shellentrager, U.S. Pat. No. 2,506,972; Zink et al., U.S. Pat. No. 3,539,285; Turpin, U.S. Pat. No. 3,547,567; and Proctor, U.S. Pat. No. 3,554,681 are illustrative of the use of steam for inducing air to aid or support combustion.

The U.S. Pat. No. 2,891,607 to Webster et al.; Zink et al., U.S. Pat. Nos. 2,779,399 and 3,570,535 and my prior U.S. Pat. No. 3,822,985 show the delivery of steam into or close to the burning gases of a flare stack in an effort to obtain smokeless combustion.

In my prior U.S. Pat. Nos. 3,797,991; 3,822,984; 3,822,985; 3,824,073 and 4,038,024, vanes with gas delivery slots are shown and in U.S. Pat. Nos. 3,797,991; 3,730,673 and 3,822,984 steam was employed to aid in the intermixing of air for completion of combustion without smoke.

The flare stack burners heretofore referred to were objectionably noisy when in operation.

In my prior U.S. Pat. No. 3,995,986 provisions are made for smokeless combustion of flare gas at low noise level.

The present invention provides greater turbulence of the gas-air mixture for burning and better delivery of air and steam exteriorly of the vortex of burning gases with improved disposal by combustion of the waste gas.

SUMMARY OF THE INVENTION

In accordance with the invention a flare stack gas burner is provided suitable for the burning of combustible waste gas from a variety of sources which includes a stack delivery pipe having horizontal outwardly extending hollow vanes or arms with fixed inclined nozzles along the top for discharge of air in a plurality of flat upwardly inclined streams in a hollow cylindrical or flaring frustoconical vortex, the inclined streams mixing with combustible gas on each face and around the exterior for completing combustion, an enclosing shroud being provided at the top through which steam delivered at the bottom induces combustion supporting air in a hollow cylindrical stream surrounding the vortex path, with additional steam being introduced into and through the cylindrical stream, the air inlet path to the cylindrical stream being shielded to reduce noise transmission, a vent seal being provided to prevent entry of air into the stack.

It is the principal object of the invention to provide a flare stack gas burner which is effective for the combustion of waste combustible gases free from smoke and at low noise level.

It is a further object of the invention to provide a flare stack gas burner in which the combustible waste gas is delivered at the top of the stack and admixed with air in an improved manner.

It is a further object of the invention to provide a flare stack gas burner in which the combustion is effected in an ascending cylindrical or flaring frusto-conical vortex with a surrounding enclosure of air, and with steam directed to the ascending column to prevent smoke formation.

It is a further object of the invention to provide a flare stack gas burner of the character aforesaid in which the component parts are simple, sturdy, trouble free, require a minimum of maintenance, and which is more effective in its burning of the waste gas than the flare burners heretofore available.

Other objects and advantageous features of the invention will be apparent from the description and claims.

BRIEF DESCRIPTION OF THE DRAWINGS

The nature and characteristic features of the invention will be readily understood from the following description taken in connection with the accompanying drawings forming part hereof, in which.

Figure 1:
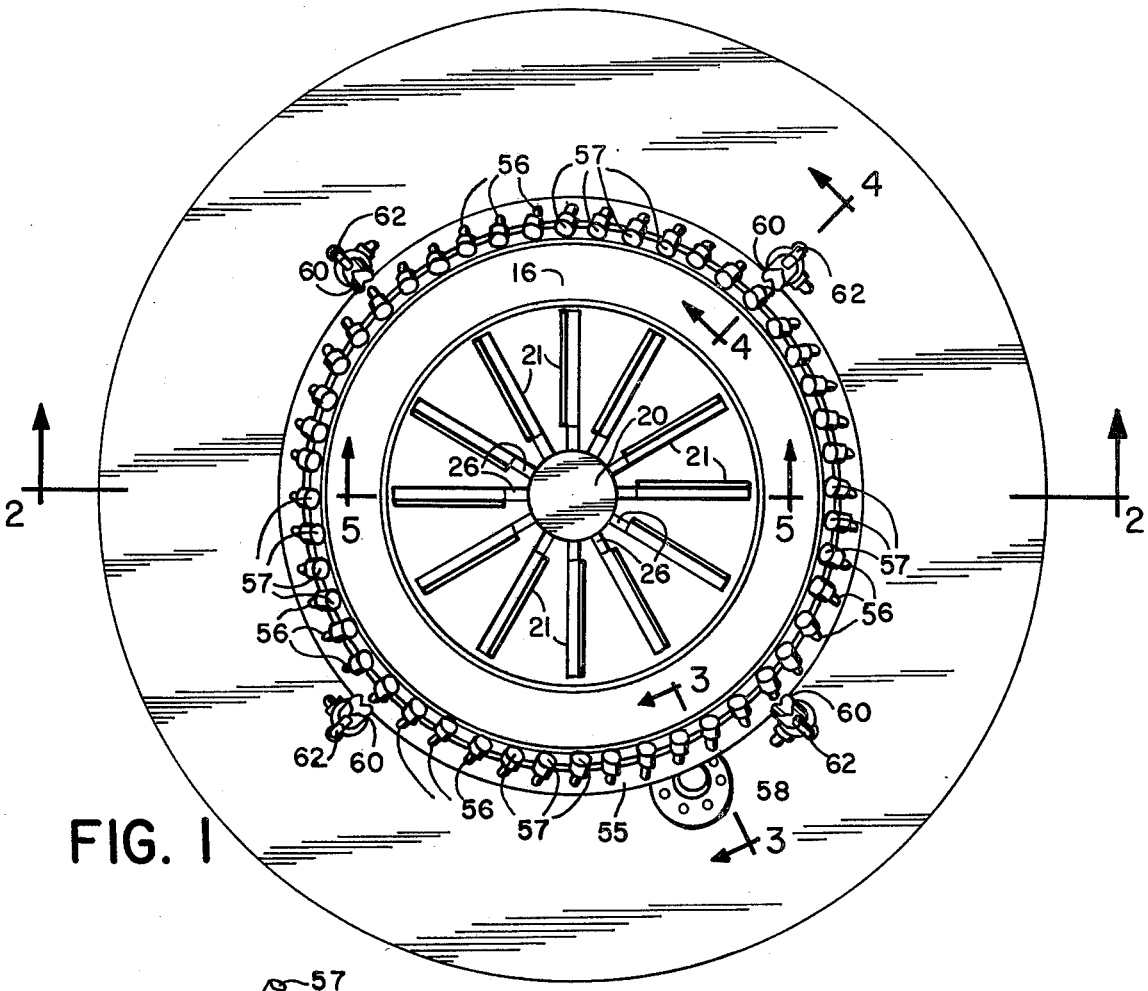
FIG. 1 is a top plan view of the flare stack gas burner in accordance with the invention.
Figure 3:
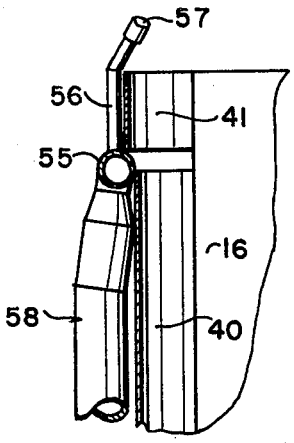
FIG. 3 is a fragmentary vertical sectional view taken approximately on the line 3—3 of FIG. 1.
Figure 4:
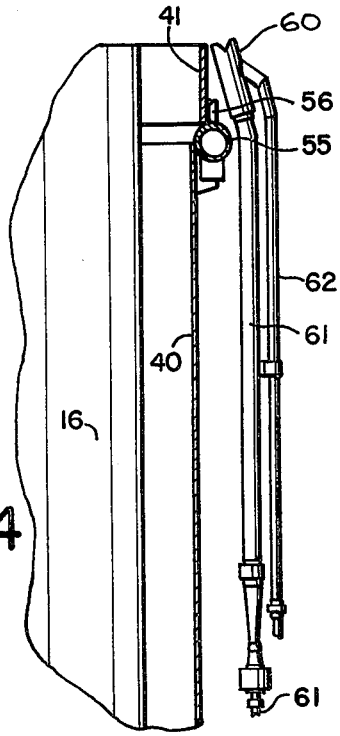
FIG. 4 is a fragmentary vertical sectional view taken approximately on the line 4—4 of FIG. 1.
Figure 2:
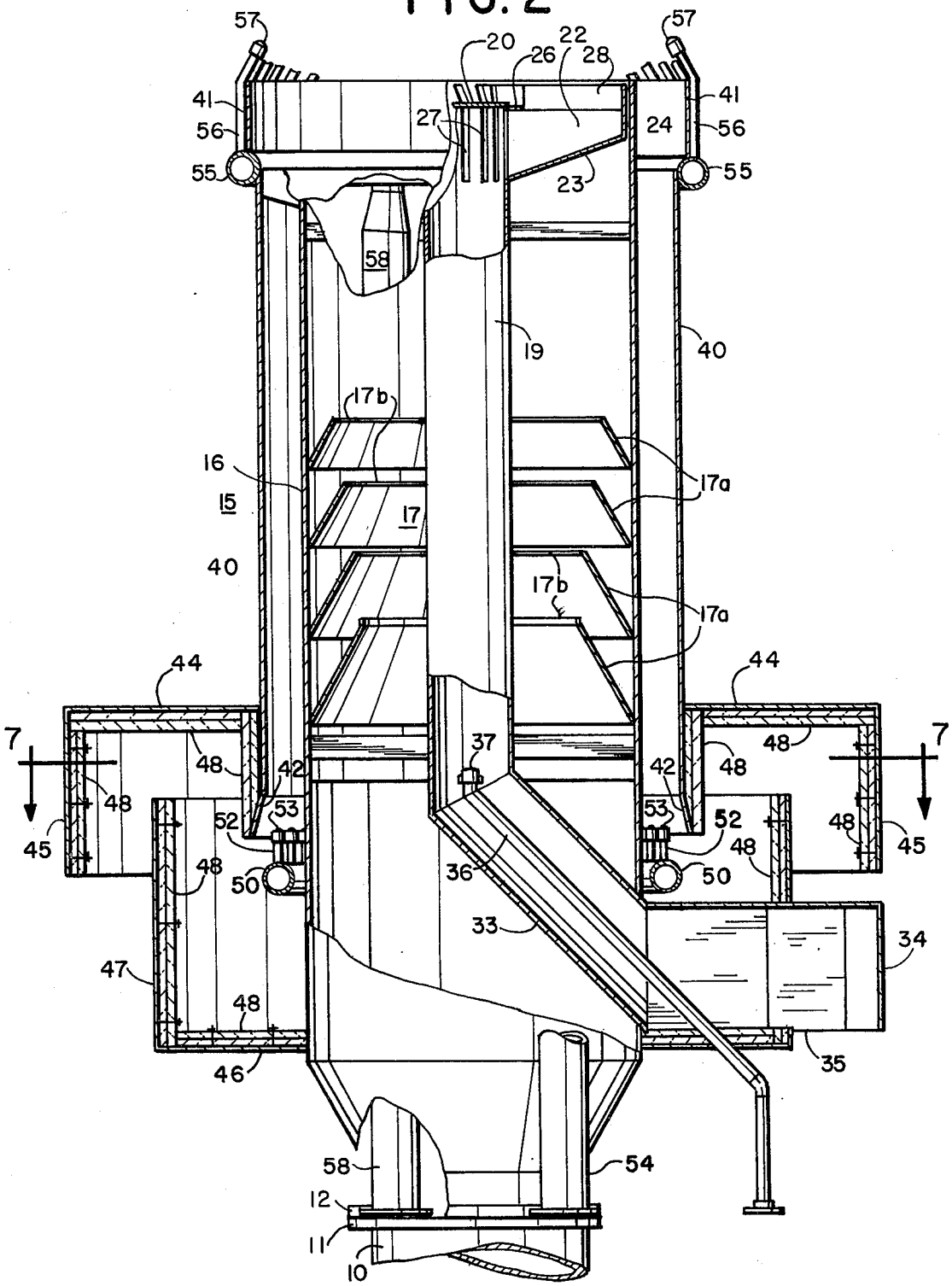
FIG. 2 is a vertical sectional view taken approximately on the line 2—2 of FIG. 1.
Figure 7:
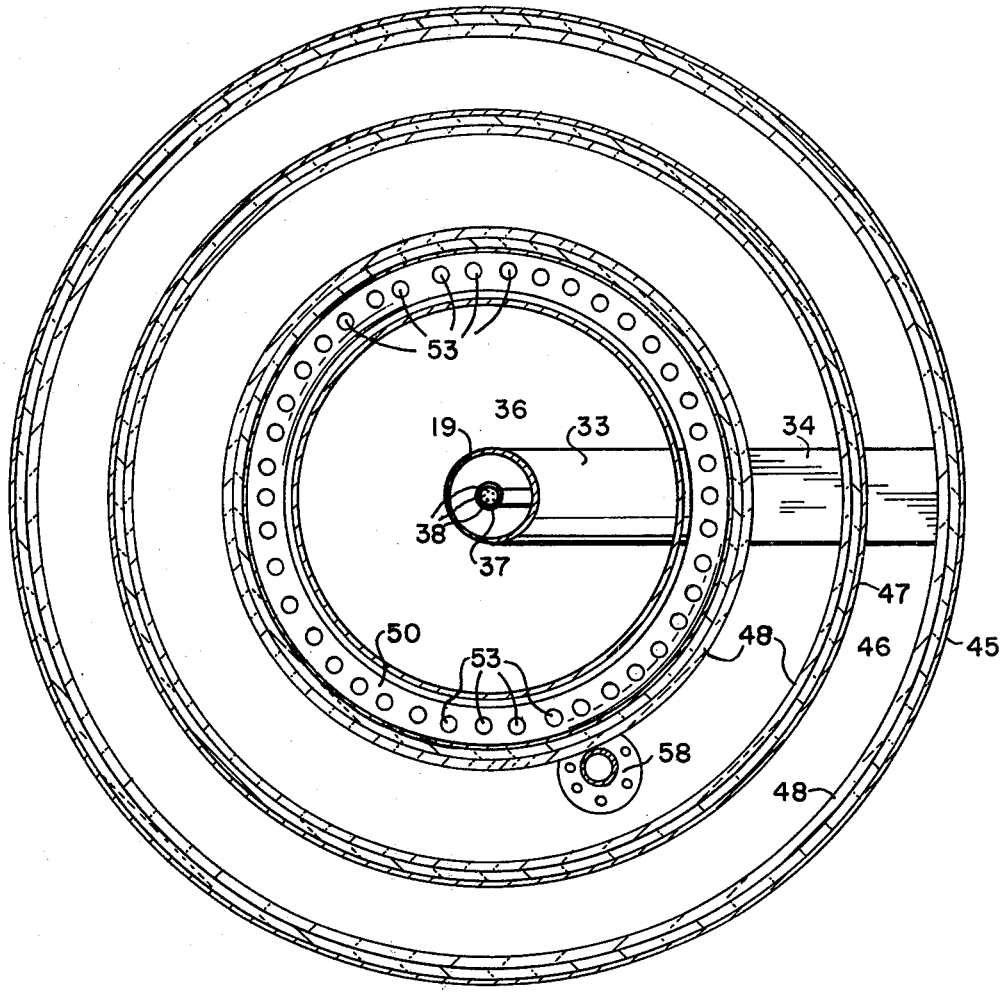
FIG. 7 is a horizontal view taken approximately on the line 7—7 of FIG. 2.
Figure 5:
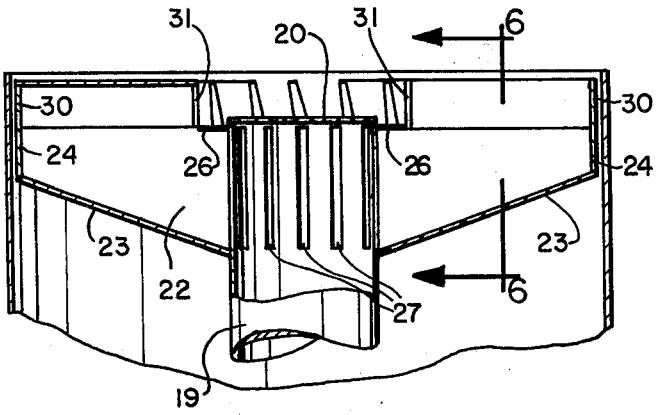
FIG. 5 is a fragmentary vertical sectional view, enlarged, taken approximately on the line 5—5 of FIG. 1.
Figure 6:
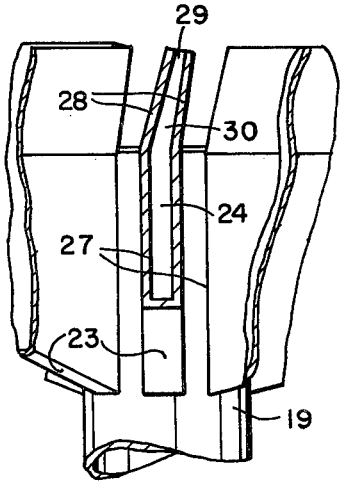
FIG. 6 is a fragmentary vertical sectional view, taken approximately on the line 6—6 of FIG. 5.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a stack pipe 10 is shown, circular in horizontal cross section which is supported in any desired manner. The stack pipe 10 can be horizontal or inclined but is preferably vertical as shown, with a flange connection 11 at its upper end for attachment of a flange 12 for the burner 15 to be described.

The pipe 10 is connected in any desired manner to a source of waste combustible gas, from industrial processes and the like and including dump gas from oil refineries.

The height of the burner in a specific embodiment can be of the order of 13 feet.

The burner 15 has a cylindrical pipe 16, preferably of larger diameter than that of the stack pipe 10 and is preferably provided, intermediate the top and bottom thereof with a fluidic diode or vent seal 17 such as that shown in my prior U.S. Pat. No. 3,730,673 which provides an obstruction to downward flow of air within the pipe 16 but does not retard the upward delivery of the combustible gas.

The fluidic diode 17 preferably comprises a plurality of frustoconical baffles 17*a* of metal or other material which is not adversely affected by the elevated temperature of the combustible gas which may be of the order of 400° to 700° Fahrenheit. The baffles 17*a* terminate at their peripheries at the cylindrical pipe 16 and have aligned central openings 17*b*, preferably of ascending increasing diameters.

Within the pipe 16, an air pipe 19 is provided, of smaller diameter than the pipe 16 and concentric therewith. The pipe 19 is closed at the top by a circular plate 20.

A plurality of vanes 21 are provided secured to and extending radially outwardly from the pipe 19 at the top thereof.

Each of the vanes 21 has spaced parallel vertical side walls 22, an outwardly extending upwardly inclined bottom wall 23, an outer vertical end wall 24, and inner horizontal connecting wall 26. The interiors of the vanes 21 are in communication with the interior of the pipe 19 through vertical openings 27 in the pipe 19.

The upper horizontal margins of the walls 22 have converging plates 28 secured thereto to provide inclined nozzles with elongated nozzle openings 29. The outer ends of the nozzle wall plates 28 are closed by upper extensions 30 of the outer end walls 24 and the inner ends of the nozzle wall plates 28 are closed by vertical walls 31.

The air pipe 19 has an inclined air supply pipe 33 extending thereto from an air inlet housing 34 with an air inlet opening 35 at the bottom.

The pipe 19 has a center steam pipe 36 therein of smaller diameter and provided with a discharge tip 37 with holes 38 therein for discharge of steam.

The tip 37 is shown as located at the intersection of the pipes 33 and 19 but the location may be varied as desired.

A pipe 40 is provided spaced from and concentric with the pipe 16 with a portion 41 at the top of the pipe 16 of increased diameter. The pipe 40 extends downwardly below the top of the pipe 33 and with a flare 42 at the bottom. The shroud or pipe 40 is preferably free from direct attachement to the pipe 16 and is supported as explained below.

Spaced above the flare 32 an upper shroud is provided having a horizontal wall 44 from which a downwardly extending cylindrical wall 45 extends.

A lower shroud is provided having a horizontal wall 46 and from which an upwardly extending wall 47 extends intermediate the wall 45 and the pipe 40 to provide a tortuous path for entry of air to the pipe 40.

The pipe 40 at its lower end, the interior of the walls 44, 45, 46, and 47 have a layer of sound absorbing material 48 secured thereto which absorbs the sound caused by air travelling to and entering the space between the pipes 16 and 40. The material 48 can be of any suitable heat resistant durable composition, with a ceramic fiber mat having a thickness of the order of 1½ inches and a density of the order of 4 pounds per cubic foot, being one of the preferred materials.

In surrounding relation to the pipe 16 and below the flare 42 a steam supply ring 50 is provided. The steam supply ring 50 has a plurality of pipes 52 extending upwardly therefrom with steam nozzles 53 for delivering steam upwardly to induce air into the tortuous path within the upper and lower shrouds and upwardly in the space between the pipes 16 and 40.

The steam supply ring 50 has a steam supply pipe 54 extending thereto which can be made relatively rigid and of sufficient strength to support the steam supply ring 50.

In surrounding and supporting relation to the pipe 40 a steam supply ring 55 is provided having a plurality of pipes 56 extending upwardly and then at an angle to the vertical and to a vertical radial plane through the central vertical axis of the pipe 16. The pipes 56 have nozzles 57 on their upper ends which may be of the type shown and described in U.S. Pat. No. 3,463,602 to Gordon M. Bitterlich.

The steam supply ring 55 has a steam supply pipe 58 extending thereto which can be made relatively rigid and of sufficient strength to support the pipe 40 and its associated structure independent of the top of the pipe 16.

A plurality of burner pilots 60 are provided with discharge heads which terminate at the top of pipe 16 and 40. The pilots 60 are shown as the venturi air inspirating type.

The pilots 60 are connected by pipes 61 to a supply of gas under pressure (not shown).

The pilots 60 are also provided with igniter tubes 62 to which a flame can be directed as desired. The pilots 60 can be in continuous or intermittent operation.

The mode of operation will now be pointed out.

Waste combustible gas supplied through the stack pipe 10 and to the burner 15 moves upwardly by its own velocity and through the openings between the vanes 21. Steam is supplied through steam pipe 36 and discharged by the nozzle 37 upwardly in the pipe 19 to draw air through the bottom opening 35 of the air inlet housing 34 and upwardly through the air supply pipe 33 and upwardly through the air pipe 19. The air moves outwardly through the slots or openings 27, outwardly through the vanes 21 and is discharged in a swirling path through the nozzle openings 29 at an inclination to the horizontal.

The movement of the air in contact with waste combustible gas moving along the outer faces of the vanes 21 and their plates 28 and imparts a swirling or vortex motion to the gas and air with mixing of the same for combustion.

At the same time air is drawn inwardly between the bottom of the wall 44 and the top of the wall 47, passing in a tortuous path and entering the space between the pipe 40 and pipe 16.

Steam delivered from the steam ring 50 and through the pipes 52 is discharged at the nozzles 53 to draw the air through the tortuous path referred to above and to advance air upwardly within the space between the pipes 16 and 40 for discharge in a hollow cylindrical path at the top of the walls 16 and 40 and in surrounding relation to the gas and air discharging from and burning at the upper parts of the vanes 21.

Steam is also delivered from the steam ring 55, pipes 56 and nozzles 57 in a swirling path and imparts to the hollow cylindrical air flow a swirling motion with admixture of steam and air to the gases discharging from and between the vanes 21 for burning.

When the combustible gas is flowing from between the vanes 21 the pilots 60 may be ignited by the igniter tubes 62 to ignite the combustible gas-air mixture at the discharge end of the burner 15.

The tortuous path for the air entrained by the steam from the nozzles 53 has noise transmission substantially reduced by absorption in the liners 48 of the middle frequency noise of the entering air. The interposed sound absorbing liners 48 prevent direct passage outwardly of sound waves of the entering air at the flare 42 as well as of the steam discharging from the nozzles 53.

The higher frequency or jet noise from the use of the steam is directional and hence tends to be directed upwardly and is less audible.

I claim:

1. A flare stack gas burner for waste combustible gas comprising a tubular stack pipe communicating with a source of combustible gas and to which combustible gas is supplied for combustion at its delivery end, an air supply pipe in communication with a source of air in said stack pipe and closed at its end, a plurality of hollow fixed vanes extending outwardly from said air-supply pipe and to the interiors of which air from said air supply pipe is delivered, a plurality of elongated flat nozzles for air delivery, at least one for each vane, through which said air from said vanes is delivered, each of said nozzles being inclined with respect to its vane and contacting combustible gas from the stack pipe between said vanes and on each side of the air streams discharged from said nozzles, and means surrounding the end of said stack for supplying additional air to the end of the tubular stack pipe and a steam pipe within said air supply pipe discharging steam for inducing air flow for combustion.

2. A flare stack gas burner as defined in claim 1 in which said last mentioned means comprises an air directing pipe in surrounding relation and spaced from said stack pipe and having an air entrance end, and steam delivery means for inducing air to the space between said stack pipe and said air directing pipe.

3. A flare stack gas burner as defined in claim 2 in which said steam delivery means includes a steam supply ring contiguous to the air entrance end and nozzles connected thereto for upward delivery of steam and impelling of air in said space in a hollow cylindrical path surrounding the air and gas exiting from said stack pipe.

4. A flare stack gas burner as defined in claim 3 in which sound deadening members are provided through which air passes to said space.

5. A flare stack gas burner as defined in claim 4 in which said sound deadening members comprise upper and lower shrouds providing a tortuous air entry path, and said shrouds have sound absorbing linings.

6. A flare stack gas burner as defined in claim 1 in which steam supplying means is provided at the delivery end of said stack pipe.

7. A flare stack gas burner as defined in claim 2 in which steam supplying means is provided at the delivery end of said stack pipe.

8. A flare stack gas burner as defined in claim 7 in which said steam supplying means includes a steam ring in surrounding relation to said air directing pipe, and a plurality of steam delivery nozzles directed upwardly with respect to said space.

9. A flare stack gas burner as defined in claim 7 in which said steam supplying means includes a steam supply ring in surrounding and supporting relation to said air directing pipe.

10. A flare stack gas burner as defined in claim 7 in which said steam supplying means includes a steam ring having a plurality of pipes extending upwardly therefrom and at an angle to direct steam in intersecting relation to the air advancing in said air directing pipe.

11. A flare stack gas burner as defined in claim 1 in which back flow preventing members are provided in said stack below said vanes.

* * * * *

UNITED STATES PATENT OFFICE

CERTIFICATE OF CORRECTION

Patent No. 4,128,389 Dated December 5, 1978

Inventor(s) John F. Straitz, III

It is certified that error appears in the above-identified patent and that said Letters Patent are hereby corrected as shown below:

Column 5

Line 14, after "pipe" insert - in said stack pipe -

Line 15, after "air" delete "in said stack pipe".

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*